US007145543B2

(12) United States Patent
Tobita

(10) Patent No.: US 7,145,543 B2
(45) Date of Patent: Dec. 5, 2006

(54) IMAGE DISPLAY UNIT

(75) Inventor: Youichi Tobita, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 402 days.

(21) Appl. No.: 10/450,148

(22) PCT Filed: Feb. 6, 2002

(86) PCT No.: PCT/JP02/00991

§ 371 (c)(1),
(2), (4) Date: Jun. 11, 2003

(87) PCT Pub. No.: WO03/067316

PCT Pub. Date: Aug. 14, 2003

(65) Prior Publication Data

US 2004/0066360 A1 Apr. 8, 2004

(51) Int. Cl.
*G09G 3/36* (2006.01)
*G09G 5/00* (2006.01)

(52) U.S. Cl. ..... 345/98

(58) Field of Classification Search ..... 345/87, 345/90, 92, 95, 98, 82, 76, 204; 315/169.3
See application file for complete search history.

(56) References Cited

U.S. PATENT DOCUMENTS 4,028,557 A * 6/1977 Wilson ..... 327/57
4,267,465 A 5/1981 Haug et al.
4,430,648 A * 2/1984 Togashi et al. ..... 345/205
6,246,436 B1 * 6/2001 Lin et al. ..... 348/308
6,278,242 B1 * 8/2001 Cok et al. ..... 315/169.1
6,864,871 B1 * 3/2005 Okada et al. ..... 345/90
2002/0118150 A1 * 8/2002 Kwon ..... 345/76
2002/0180675 A1 12/2002 Tobita et al.

FOREIGN PATENT DOCUMENTS

| | | |
|---|---|---|
| JP | 58-12677 | 3/1983 |
| JP | 04022923 | 1/1992 |
| JP | 11316366 | 11/1999 |
| JP | 2000223279 | 8/2000 |
| JP | 2001305511 | 10/2001 |

* cited by examiner

*Primary Examiner*—Amr A. Awad
*Assistant Examiner*—Stephen G Sherman
(74) *Attorney, Agent, or Firm*—Leydig, Voit & Mayer, Ltd.

(57) ABSTRACT

A color image display includes: a liquid crystal cell having a light transmittance varying according to a potential at a data holding node; a scan circuit applying one of first and second potentials to the data holding node in accordance with an image signal; and a refresh circuit refreshing potential at the data holding node to a first potential in response to a refresh signal when the potential at the data holding node exceeds a threshold potential of an N-type TFT, and not refreshing the potential at the data holding node when the potential at the data holding node does not exceed the threshold potential.

16 Claims, 13 Drawing Sheets

IMAGE DISPLAY UNIT

TECHNICAL FIELD

The present invention relates to an image display and, more particularly, to an image display that requires refreshing of a data signal.

BACKGROUND ART

A liquid crystal display for displaying a still picture and a moving picture has conventionally been employed in a personal computer, a television receiver, a portable telephone, a portable information terminal and the like.

FIG. 17 is a circuit diagram showing a main part of such a liquid crystal display. In FIG. 17, this liquid crystal display includes a liquid crystal cell 70, a scan line 71, a common potential line 72, a data signal line 73 and a liquid crystal drive circuit 74, wherein liquid crystal drive circuit 74 includes an N-type TFT (Thin Film Transistor) 75 and a capacitor 76.

N-type TFT 75 is connected between data signal line 73 and a data holding node N75 and having the gate connected to scan line 71. Capacitor 76 is connected between data holding node N75 and common potential line 72. One electrode of liquid crystal cell 70 is connected to data holding node N75 and the other electrode thereof receives a reference potential VR. Common potential line 72 is applied with a common potential VC. Scan line 71 is driven by a vertical scan circuit (not shown) and data signal line 73 is driven by a horizontal scan circuit (not shown).

When scan line 71 is set to "H" level, N-type TFT 75 is made conductive to charge data holding node N75 to a level on data signal line 73 through N-type TFT 75. A light transmittance of liquid crystal cell 70 increases to the maximum when data holding node N75 is at "H" level, for example, while the light transmittance decreases to the minimum when data holding node N75 is at "L" level. Liquid crystal cells 70 are arranged in a plurality of rows and a plurality of columns to form one liquid crystal panel, on which one picture is displayed.

In such a liquid display, an electric charge of data holding node 75 gradually leaks to gradually decrease a potential thereof and to vary a light transmittance of liquid crystal cell 70 even when N-type TFT 75 is non-conductive. Therefore, as shown in FIG. 18, a data signal is refreshed, that is to say a data signal is rewritten to data holding node 75, at prescribed intervals.

In a conventional liquid crystal display, it was required that a plurality of scan lines 71 were selected one at a time and a data signal was rewritten to data holding nodes N75 corresponding to one selected scan line 71 while one selected scan line 71 was in a selected state, therefore, a problem has arisen that control for refreshing of a data signal becomes complex.

DISCLOSURE OF THE INVENTION

Accordingly, it is a main object of the present invention to provide an image display capable of refreshing a data signal with ease.

An image display according to the present invention includes: a pixel display circuit displaying a pixel density corresponding to a potential of a data holding node; a data write circuit applying one of first and second potentials to the data holding node in accordance with an image signal; and a refresh circuit performing refresh of a potential at the data holding node in response to a refresh signal when the potential at the data holding node exceeds a predetermined third potential between the first and second potentials while performing no refresh of the potential at the data holding node in response to the refresh signal when the potential at the data holding node does not exceed the third potential. Therefore, since a potential at the data holding node is refreshed by the refresh circuit when a refresh signal is supplied thereto, refresh of a data signal can be performed with ease.

Preferably, the refresh circuit includes a capacitor having one electrode receiving a potential at the data holding node, having the other electrode receiving the refresh signal, and a capacitance value of which varies according to a potential difference between the one electrode and the other electrode. In this case, a change in capacitance value of the capacitor according to a potential at the data holding node is used to make it possible to select whether or not refresh of the potential at the data holding node is performed.

Preferably, the capacitor includes an N-channel field effect transistor, having a gate electrode serving as the one electrode, and having at least one of first and second electrodes serving as the other electrode. In this case, a capacitance value of the capacitor increases when a positive voltage is applied between the one electrode and the other electrode of the capacitor.

Preferably, the capacitor includes a P-channel field effect transistor having a gate electrode serving as the other electrode, and having at least one of first and second electrodes serving as the one electrode. In this case, a capacitance value of the capacitor increases when a negative voltage is applied between the other electrode and the one electrode of the capacitor.

Preferably, the refresh circuit further includes: a first field effect transistor, connected between one electrode of the capacitor and the data holding node, and having a gate electrode receiving a first drive potential; and a second field effect transistor having a first electrode receiving a second drive potential, having a second electrode connected to the data holding node, and having a gate electrode connected to one electrode of the capacitor. In this case, the second field effect transistor is made conductive to refresh a potential at the data holding node when a potential at the one electrode of the capacitor exceeds a prescribed potential in response to a refresh signal, while the second field effect transistor does not made conductive to refresh no potential at the data holding node when a potential at the one electrode of the capacitor does not exceed a prescribed voltage in response to a refresh signal.

Preferably, the first drive potential is equal to a potential of the sum of the first potential and a threshold voltage of the first field effect transistor, and the second drive potential is equal to the first potential. An activation level of the refresh signal is equal to the first potential and a deactivation level thereof is equal to the second potential. In this case, a potential at the data holding node is refreshed to the first potential in response to transition of the second field effect transistor to a conductive state.

Preferably, the refresh circuit further includes a third field effect transistor, interposed between a node at the second drive potential and the first electrode of the second field effect transistor, having a gate electrode receiving the refresh signal. In this case, reduction is enabled in a leakage current from the node at the second drive potential to the data holding node.

Preferably, the first drive potential is equal to a potential of the sum of the first potential and the threshold voltage of the first field effect transistor, and the second drive potential is equal to the first potential. The activation level of the refresh signal is equal to a potential of the sum of the first potential and the threshold voltage of the third field effect transistor, and the deactivation thereof is equal to the second potential. In this case, a potential at the data holding node is refreshed to the first potential in response to transition of the second and third field effect transistors to a conductive state. Voltage drop in the third field effect transistor can be prevented from occurring.

Preferably, the second drive potential is applied only during a prescribed period including a period in which the refresh signal is set at the activation level. In this case, more reduction is enabled in leakage current from the node at the second drive potential to the data holding node.

Preferably, the refresh circuit further includes: a third field effect transistor, interposed between the node at the second drive potential and the first electrode of the second field effect transistor, having a gate electrode receiving a control signal in synchronism with the refresh signal. In this case, reduction is enabled in a leakage current from the node at the second drive potential to the data holding node.

Preferably, the first drive potential is equal to a potential of the sum of the first potential and the threshold voltage of the first field effect transistor, and the second drive potential is equal to the first potential. The activation level of the refresh signal is equal to the first potential and the deactivation level thereof is equal to a potential obtained by level shifting the second potential to the first potential side by a predetermined first voltage. The activation level of the control signal is equal to a potential of the sum of the first potential and a threshold voltage of the third field effect transistor, and the deactivation level thereof is equal to a potential obtained by level shifting the second potential to the side opposed to the first potential side by a predetermined second voltage. In this case, a potential at the data holding node is refreshed to the first potential in response to transition of the second and third field effect transistors to a conductive state. A change in potential at the data holding node can be suppressed to be small in the case where a potential at the data holding node is not refreshed.

Preferably, the second drive potential is applied only during a prescribed period including a period in which the refresh signal and the control signal are set at the activation levels. In this case, more reduction is enabled in leakage current from the node at the second drive potential to the data holding node.

Preferably, there is further provided a capacitor connected between the data holding node and a node at a reference potential. In this case, since a potential at the data holding node is maintained by the capacitor, a change becomes smaller in potential at the data holding node.

Preferably, the pixel display circuit includes a liquid crystal cell having one electrode connected to the data holding node, having the other electrode receiving a drive potential, and a light transmittance of which varies according to a potential at the data holding node. In this case, a pixel density varies according to a light transmittance of the liquid crystal cell.

Preferably, the pixel display circuit includes: a field effect transistor having a gate electrode connected to the data holding node, and having a first electrode receiving the reference potential; and a liquid crystal cell having one electrode connected to a second electrode of the field effect transistor, having the other electrode receiving a drive potential, and a light transmittance of which varies according to a conductive state/non-conductive state of the field effect transistor. In this case, the field effect transistor is brought into the conductive or non-conductive state according to whether or not a potential at the data holding node exceeds a threshold voltage of the field effect transistor to thereby cause a light transmittance of the liquid crystal cell to be the maximum or minimum.

Preferably, the pixel display circuit includes: a field effect transistor having a gate electrode connected to the data holding node, and having a first electrode receiving a first drive voltage; a switch circuit applying a second drive potential to a prescribed node in response to a reset signal, and connecting a second electrode of the field effect transistor to the prescribed node in response to a set signal; and a liquid crystal cell having one electrode connected to the prescribed node, having the other electrode receiving a reference potential, and a light transmittance of which varies according to a potential at the prescribed node. In this case, after a potential is written to the data holding node, a reset signal and a set signal are alternately inputted to thereby enable the prescribed node to take the first or second drive potential, which makes it possible to adjust a light transmittance of the liquid cell to the maximum or the minimum.

Preferably, the pixel display circuit includes: a field effect transistor having a gate electrode connected to the data holding node; and a light emitting element, connected in series with the field effect transistor between a node at a drive potential and a node at a reference potential, and a light intensity of which varies according to a current flowing in the field effect transistor. In this case, a pixel density varies according to a light intensity of the light emitting element.

Preferably, there are provided a plurality of pixel display circuits arranged in a plurality of rows and a plurality of columns, wherein the data write circuit includes: a plurality of scan lines provided correspondingly to the plurality of rows, respectively; a plurality of data signal lines provided correspondingly to the plurality of columns, respectively; field effect transistors, provided correspondingly to the respective pixel display circuits, each connected between the data holding node of a corresponding pixel display circuit and a corresponding data signal line, and each having a gate electrode connected to a corresponding scan line; a vertical scan circuit sequentially selecting the plurality of scan lines to drive a selected scan line to a select level and to cause a field effect transistor corresponding to the selected scan line to be made conductive; and a horizontal scan circuit sequentially selecting the plurality of data signal lines while one scan line is selected by the vertical scan circuit to apply one of the first and second potentials onto a data line selected according to the image signal. In this case, an image in two dimensions can be displayed.

BEST MODE FOR CARRYING OUT THE INVENTION

Embodiment 1

Figure 1:
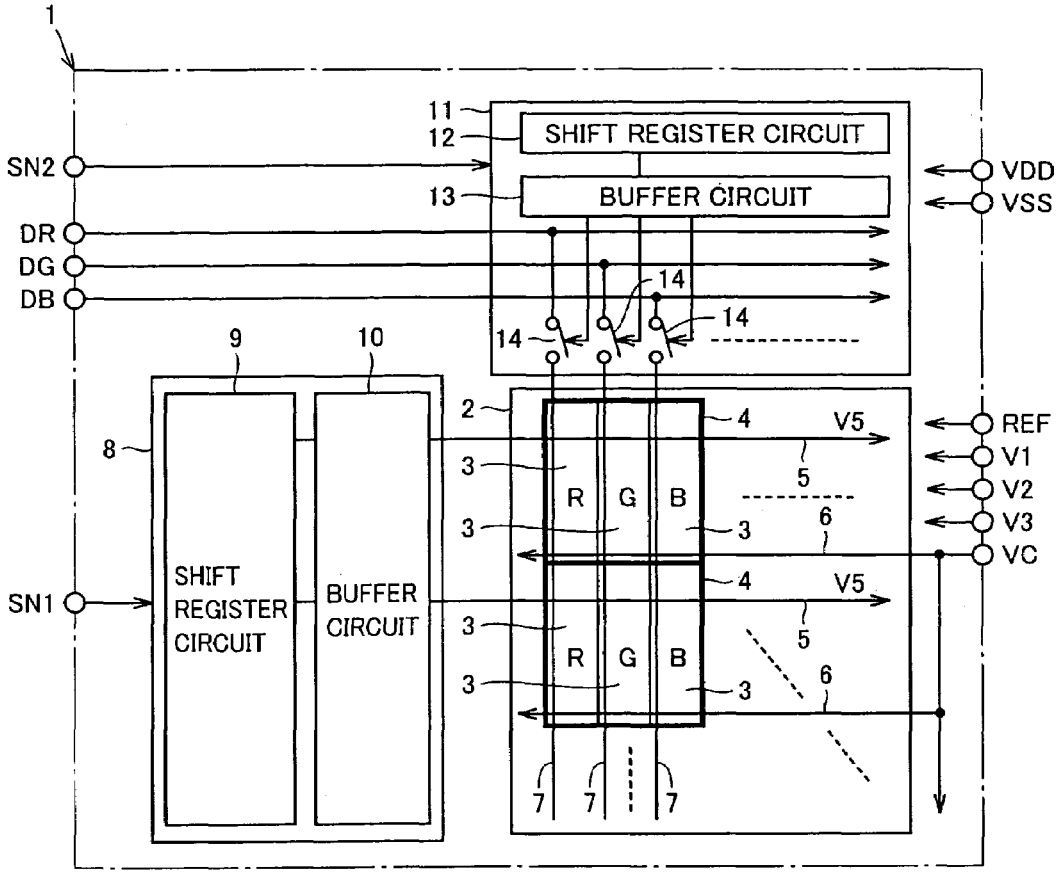
FIG. 1 is a circuit block diagram showing an overall configuration of a color liquid crystal display according to Embodiment 1 of the present invention.

FIG. 1 is a circuit block diagram showing an overall configuration of a color liquid crystal display according to Embodiment 1 of the present invention. In FIG. 1, color liquid crystal display 1 includes a liquid crystal panel 2, a vertical scan circuit 8 and a horizontal scan circuit 11, and is driven by a power supply potential VDD and a ground voltage VSS applied externally.

Liquid crystal panel 2 includes: a plurality of liquid crystal cells 3 arranged in a plurality of rows and a plurality of columns; scan lines 5 and common potential lines 6 provided correspondingly to respective rows; and data signal lines 7 provided correspondingly to respective columns.

Liquid crystal cells 3 are grouped into sets of three cells in each row in advance. The three liquid crystal cells 2 of each set are provided with color filters for R, G and B, respectively. The three liquid crystal cells 3 of each set constitute one pixel 4.

A common potential VC is externally applied onto common potential lines 6. A refresh signal REF and drive potentials V1, V2 and V3 are externally applied to liquid crystal panel 2.

Vertical scan circuit 8 includes a shift register circuit 9 and a buffer circuit 10. Shift register circuit 9 generates a signal for sequentially selecting a plurality of scan lines 5 of liquid crystal panel 2 in synchronism with a horizontal and vertical synchronous signal SN1 supplied externally. Buffer circuit 10 buffers an output signal of shift register circuit 9 to supply the resulting signal to selected scan line 5. Therefore, the plurality of scan lines 5 of liquid crystal panel 2 are sequentially driven to "H" level at select level for a prescribed time on each scan line 5. When scan line 5 is driven to "H" level at select level, pixels 4 corresponding to scan line 5 are activated.

Horizontal scan circuit 11 includes a shift register circuit 12, a buffer circuit 14 and a plurality of switches 14. The plurality of switches 14 are provided correspondingly to a plurality of data signal lines 7, respectively, and are grouped into sets of three switches corresponding to respective sets of liquid crystal cells 2 in advance. One electrodes of three switches of each set receive data signals DR, DG and DB for R, G and B, respectively, and the other electrodes thereof are connected to corresponding three data signal lines 7, respectively. Shift register circuit 12 generates a signal sequentially selecting a plurality of switch sets in synchronism with horizontal synchronous signal SN2 supplied externally for a prescribed time to each switch set. Buffer circuit 10 buffers an output signal of shift register circuit 12 to supply the resulting signal to the control terminals of switches 14 of a selected set and to cause switches 14 to be made conductive. Therefore, data signals DR, DG and DB are sequentially supplied to the plurality of pixels 4 in a selected row.

When all pixels 4 of liquid crystal panel 2 are scanned by vertical scan circuit 8 and horizontal scan circuit 11, one image is displayed on liquid crystal panel 2.

Figure 2:
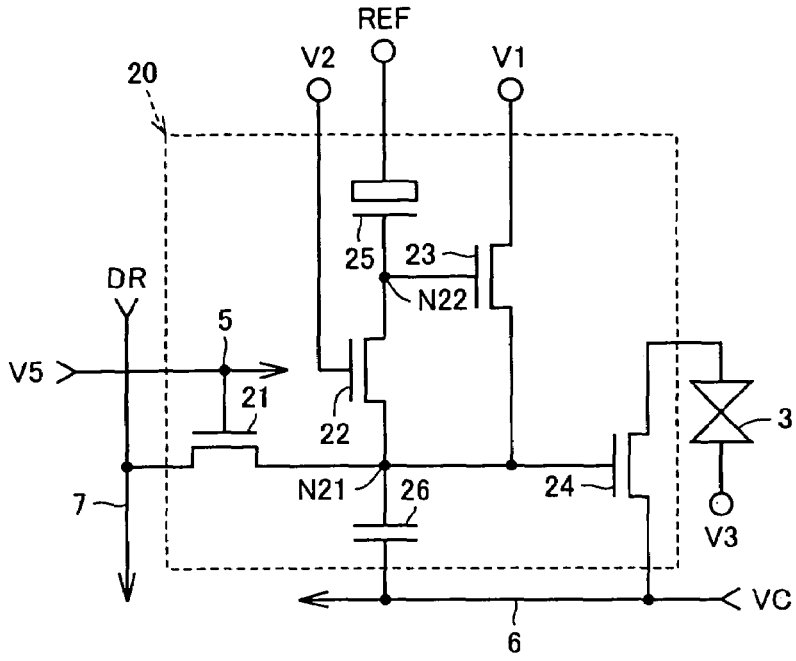
FIG. 2 is a circuit diagram showing a configuration of a liquid crystal drive circuit provided correspondingly to each liquid crystal cell shown in FIG. 1.

FIG. 2 is a circuit diagram showing a configuration of a liquid crystal drive circuit 20 provided correspondingly to each liquid crystal cell 3. In FIG. 2, liquid crystal drive circuit 20 includes enhanced N-type TFTs 21 to 24 and capacitors 25 and 26, and not only is connected to corresponding liquid crystal cell 3, scan line 5, common potential line 6 and signal line 7, but also receives refresh signal REF and drive potentials V1 and V2. In FIG. 2, there is shown liquid crystal drive circuit 20 corresponding to R of R, G and B.

N-type TFT 21 is connected between corresponding data signal line 7 and data holding node N21, and the gate thereof is connected to corresponding scan line 5. Capacitor 26 is connected between data holding node N21 and common potential line 6. N-type TFT 24 is connected between one electrode of corresponding liquid crystal cell 3 and common potential line 6, and the gate thereof is connected to data holding node N21. The other electrode of liquid crystal cell 3 receives a drive voltage V3.

When scan line 5 is driven to "H" level at select level, N-type TFT 21 is made conductive, and data holding node N21 is charged at a potential on data signal line 7. When scan line 5 is driven to "L" level at non-select level, N-type TFT 21 is made non-conductive, and a potential at data holding node N21 is held by capacitor 26.

When data holding node N21 is at "H" level, N-type TFT 24 is made conductive, a drive voltage V3−VC is applied between electrodes of liquid crystal cell 3, and a light transmittance of liquid crystal cell 3 is maximized, for example. When data holding node N21 is at "L" level, N-type TFT 24 is made non-conductive, no drive voltage is applied between electrodes of liquid crystal cell 3, and a light transmittance of liquid crystal cell 3 is minimized, for example.

Since a potential at data holding node N21 gradually falls by gradual leakage of an electric charge of data holding node N21, a necessity arises for refreshing (rewriting) of a data signal at prescribed time intervals. N-type TFTs 22 and 23 and capacitor 25 constitute a refresh circuit.

N-type TFT 22 is connected between a node N22 and data holding node N21, and the gate thereof receives drive potential V2. Drive potential V2 is set to a potential VH+VTN obtained by adding a threshold voltage VTN of N-type TFT to "H" level VH of data signal DR. Therefore, no voltage drop occurs due to threshold voltage VTN of N-type TFT 22 to cause potentials at nodes N21 and N22 to be equal to each other.

The drain of N-type TFT 23 receives drive potential V1, the source thereof is connected to data holding node N21, and the gate thereof is connected to node N22. Drive voltage V1 is set to a prescribed potential equal to or higher than "H" level VH of data signal DR. It is herein assumed that V1=VH. When potentials at nodes N21 and N22 are equal to each other, N-type TFT 23 is non-conductive. When a potential at node N22 rises to VH+VTN or higher, N-type TFT 23 is made conductive to cause data holding node N21 to be at V1=VH.

Capacitor 25 is a capacitor of an N-type TFT (of an enhancement type) structure, the gate thereof is connected to node N22, and the source thereof receives refresh signal REF. When a gate to source voltage of capacitor 25 is higher than threshold voltage VTN of N-type TFT, capacitor 25 has a prescribed capacitance value. When a gate to source voltage of capacitor 25 is lower than threshold voltage VTN of N-type TFT, capacitor 25 has a considerably small capacitance value only corresponding to a parasitic capacitance.

Figure 3:
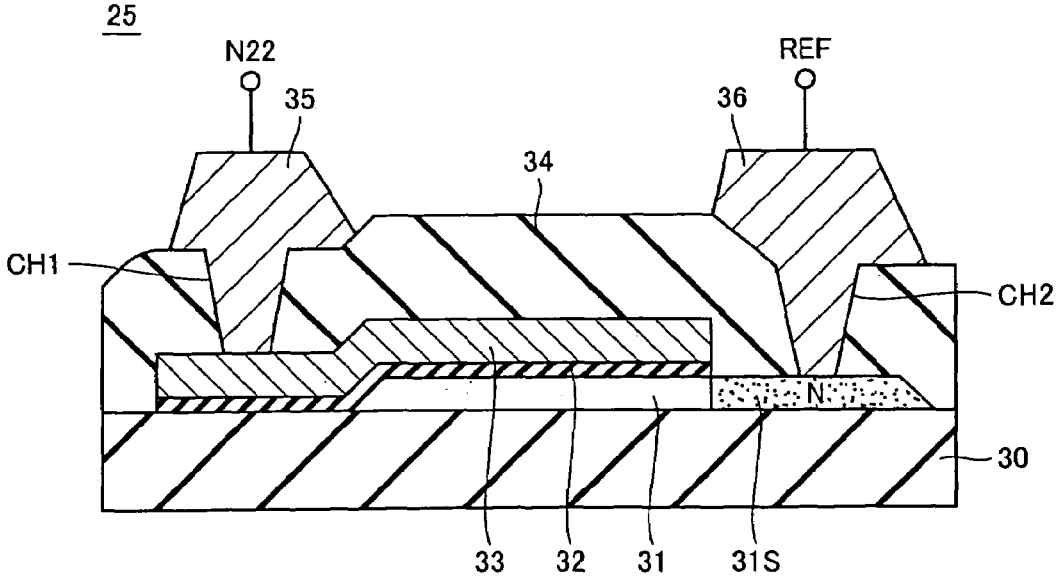
FIG. 3 is a sectional view showing a construction of a capacitor 25 shown in FIG. 2.

FIG. 3 is a sectional view showing a configuration of capacitor 25. In FIG. 3, an intrinsic polysilicon film 31 is formed in a prescribed region on a surface of a glass substrate 30. Then, a gate insulating film 32 is formed so as to cover part of intrinsic polysilicon film 31 and, further, a gate electrode 33 is laminated on gate insulating film 32. N-type impurity is injected into portion which is not covered by gate insulating film 32 and gate electrode 32 on intrinsic polysilicon film 31 to form a source region 31*s*. Then, an interlayer insulating film 34 is formed so as to cover all the region, a contact hole CH1 is opened from a surface of interlayer insulating film 34 to a surface of gate electrode 33, and a contact hole CH2 is opened from the surface of interlayer insulating film 34 to a surface of source region 31*s*. Then, aluminum electrodes 35 and 36 are formed so as to fill and cover contact holes CH1 and CH2. Aluminum electrode 35 (gate) is connected to node N22, and aluminum electrode (source) 36 receives refresh signal REF.

When a voltage higher than threshold voltage VTN of N-type TFT is applied between the gate and source, an N-type channel layer is formed on a surface of intrinsic polysilicon film 31 below gate electrode 33 to generate prescribed capacitance value between the gate and source.

When a voltage lower than threshold voltage VTN of N-type TFT is applied between the gate and source, no N-type channel layer is formed on the surface of intrinsic polysilicon film 31; therefore, a capacitance value between the gate and source is a considerably small value only corresponding to a parasitic capacitance.

Note that a configuration may be adopted in which not only is a gate electrode formed in the central portion on the surface of the intrinsic polysilicon film with a gate insulating film interposed therebetween in a similar way to the case of an ordinary TFT, but impurity is also injected at both sides of the gate electrode to form a source region and a drain region and, in addition, not only is the gate electrode connected to one aluminum electrode, but the source region and the drain region are connected commonly to the other aluminum electrode to form a capacitor.

Figure 4:
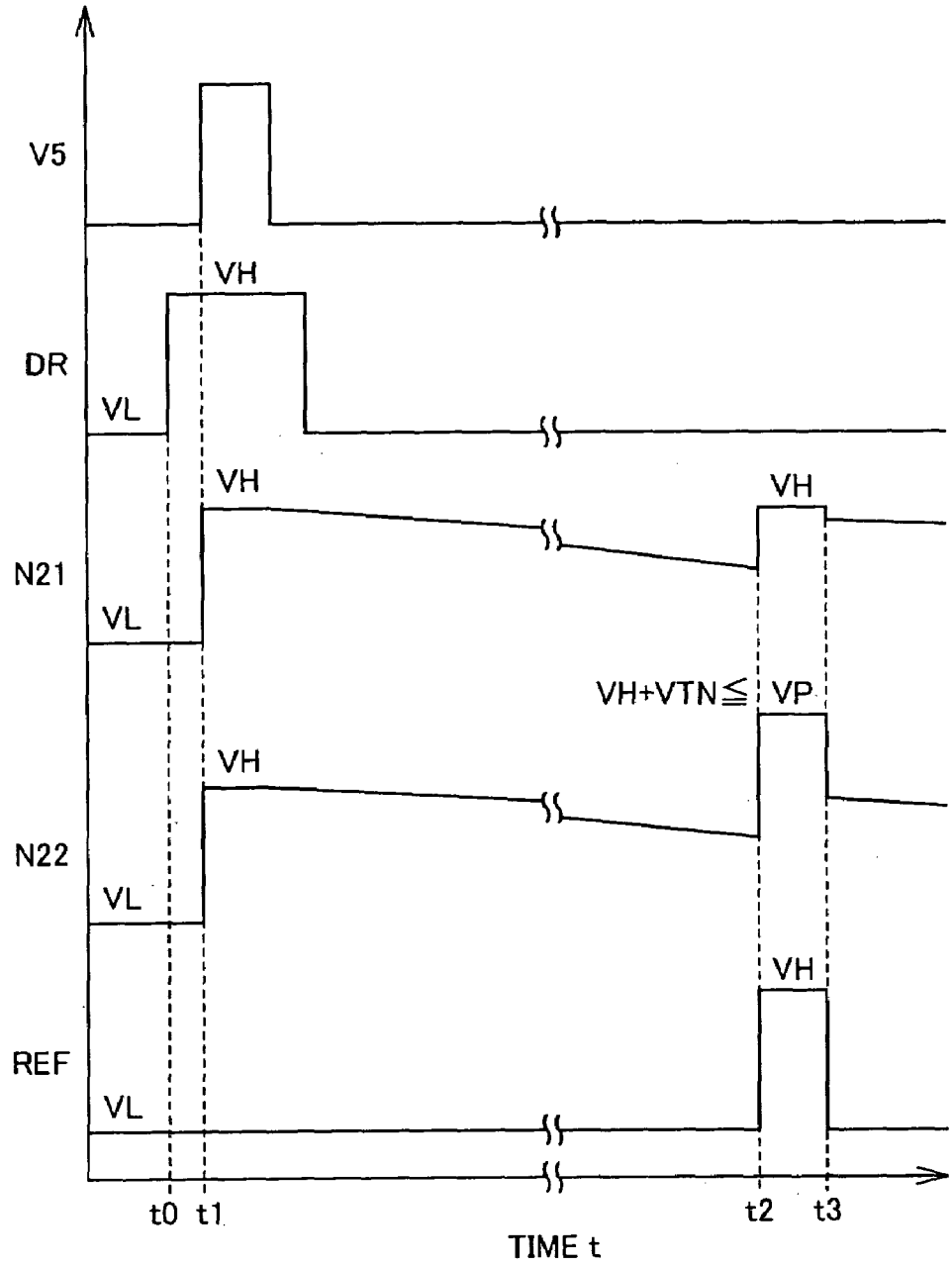
FIG. 4 is a timing chart for describing an operation of the liquid crystal drive circuit shown in FIG. 2.

FIG. 4 is a timing chart for describing an operation of liquid crystal drive circuit 20 in the case where data signal DR is at "H" level VH. In FIG. 4, in an initial state, potential V5 on scan line 5 is set to "L" level, data signal DR is set to "L" level VL, nodes N21 and N22 are reset to "L" level VL, and refresh signal REF is set to "L" level.

At time t0, data signal DR is raised from "L" level VL to "H" level VH and, then, at time t1, potential V5 on scan line 5 is raised from "L" level to "H" level. Thereby, N-type TFT 21 is made conductive to raise nodes N21 and N22 from "L" level VL to "H" level VH. When a prescribed time elapses thereafter, potential V5 on scan line 5 is lowered to "L" level and, then, data signal DR is also lowered to "L" level. When potential V5 on scan line 5 is raised to "L" level, N-type TFT 21 is made non-conductive to cause potentials at nodes N21 and N22 to be held by capacitor 26. Since potential VH at data holding node N22 is higher than threshold potential VTN of N-type TFT 24, N-type TFT 24 is made conductive to apply drive voltage V3−VC between electrodes of liquid crystal cell 3 and to, for example, maximize a light transmittance of liquid crystal cell 3.

When liquid crystal cell is left in this state, potentials at nodes N21 and N22 are gradually lowered by leakage current. When a potential at node N21 is lowered to a value lower than threshold potential VTN of N-type TFT 24, N-type TFT is made non-conductive to vary a light transmittance of liquid crystal cell 3 from the maximum to the minimum. Therefore, refresh of a data signal is performed at prescribed time t2 before potentials at nodes N21 and N22 are lowered to a value lower than threshold potential VTN of N-type TFT 24.

Since, at time t2, potentials at nodes N21 and N22 are higher than threshold potential VTN of N-type TFT, an N-type channel layer is generated in intrinsic polysilicon film 31 of capacitor 25, and capacitor 25 has a prescribed capacitance value. At time t2, when refresh signal REF is raised from "L" level VL to "H" level VH, a potential at node N22 is raised to a boosted potential VP (≧VH+VTN) by capacitive coupling to cause N-type TFT 23 to be made conductive and to raise node N21 to drive potential V1=VH. Thereby, potential VH at data holding node N21 has been refreshed. At time t3, when refresh signal REF is lowered from "H" level VH to "L" level VL, potentials at nodes N21 and N22 are lowered by capacitive coupling, but since a capacitance value of capacitor 26 is sufficiently larger than a capacitance value of capacitor 25, potentials at nodes N21 and N22 are maintained at "H" level VH.

Figure 5:
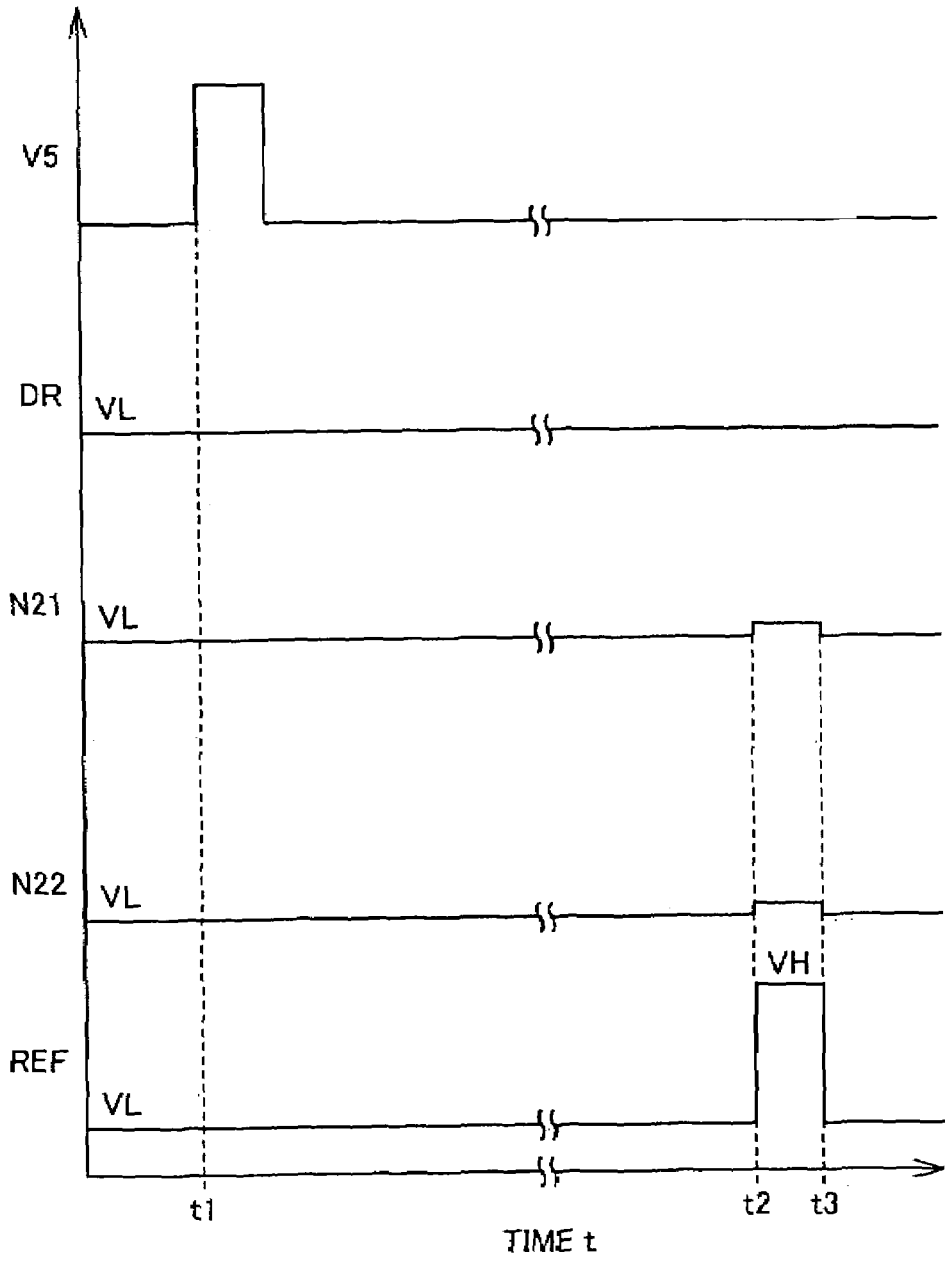
FIG. 5 is another timing chart for describing an operation of the liquid crystal drive circuit shown in FIG. 2.

FIG. 5 is a timing chart for showing an operation of liquid crystal drive circuit 20 in the case where data signal DR is at "L" level VL. In FIG. 5, data signal DR is fixed at "L" level VL. Therefore, at time t1, potential V5 on scan line 5 is raised to "H" level and kept there for a prescribed time and even if N-type TFT 21 is in a conductive state only for a prescribed time, nodes N21 and N22 are maintained as is at "L" level VL.

At time t2, when a prescribed time is elapsed from time t1, since potentials at nodes N21 and N22 are lower than threshold potential VTN of N-type TFT, no N-type channel layer is generated in intrinsic polysilicon film 31 of capacitor 25, and a capacitance value of capacitor 25 has a considerably small value only corresponding to a parasitic capacitance. Therefore, even if, at time t2, refresh signal REF is raised from "L" level VL to "H" level VH, nodes N21 and N22 are maintained almost at "L" level VL. Therefore, in this case, a potential at data holding node N21 is not refreshed. At time t3, even when refresh signal REF is lowered from "H" level VH to "L" level VL, nodes N21 and N22 are maintained at "L" level VL since a capacitance value of capacitor 25 is small.

In Embodiment 1, since no necessity arises for driving scan line 5 and data signal line 7 at the time of refreshing a data signal, a refresh control can be implemented with ease. Furthermore, since no necessity arises for operating vertical scan circuit 8 and horizontal scan circuit 11 at the time of refreshing a data signal, power consumption can be reduced.

Figure 6:
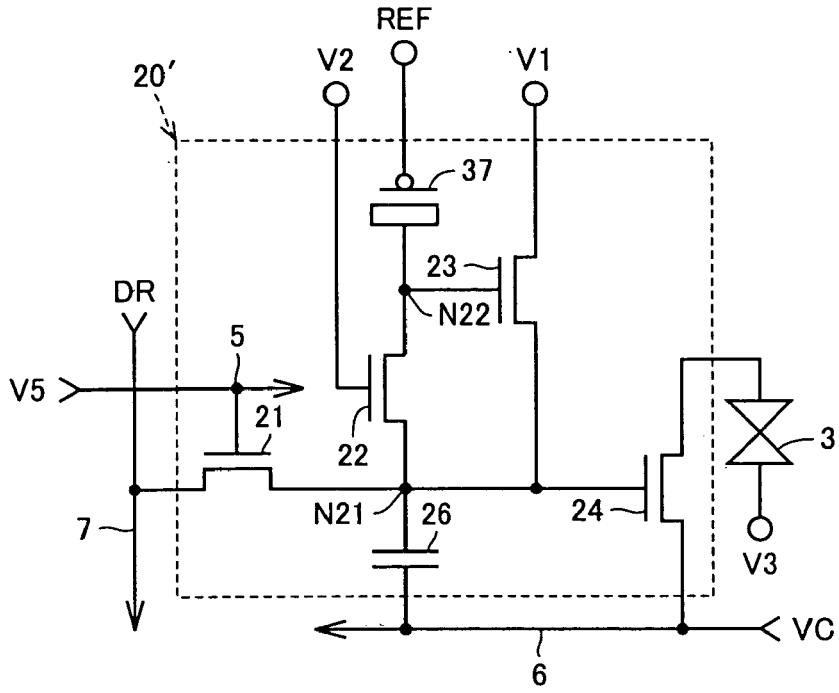
FIG. 6 is a circuit diagram showing a modification example of Embodiment 1.
Figure 7:
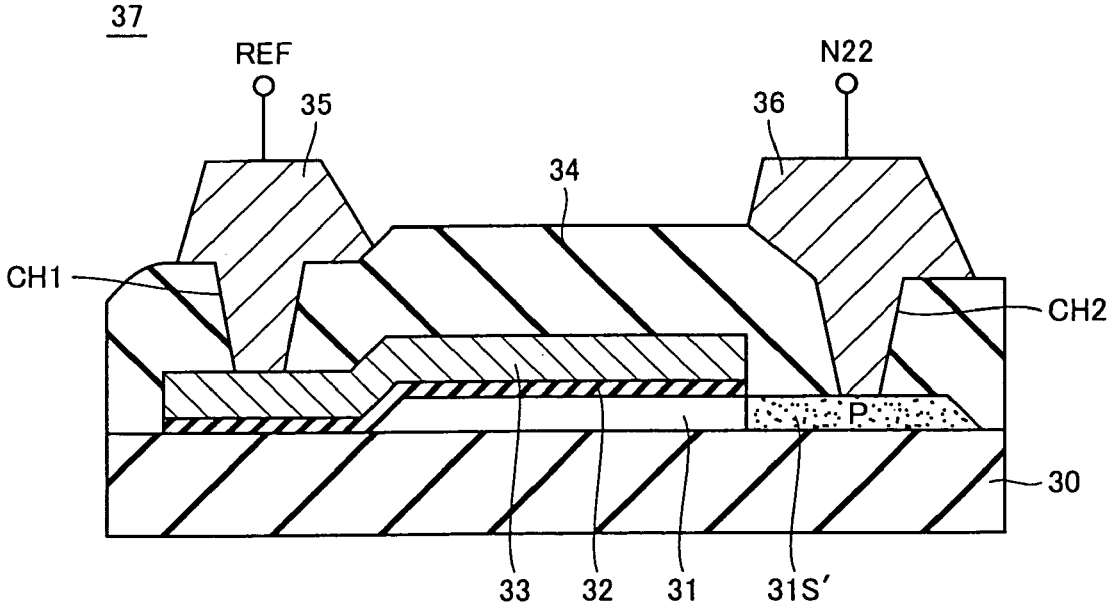
FIG. 7 is a sectional diagram showing a configuration of a capacitor 37 shown in FIG. 6.

In a modification example of FIG. 6, capacitor 25 having an N-type TFT structure is replaced with a capacitor 37 having a P-type TFT (of a enhancement type) structure. Capacitor 37 is, as shown in FIG. 7, of a structure in which N-type source region 31s of capacitor 25 is replaced with a P-type source region 31*s'*. The gate of capacitor 37 receives refresh signal REF and the source thereof is connected to node N22. In this modification example as well, there is obtained the same effect as in Embodiment 1.

Embodiment 2

In Embodiment 1, description has been given that when nodes N21 and N22 are at "L" level VL, N-type TFT is made non-conductive. However, a case arises where a considerably small current (an off current) flows in N-type TFT 23 even at a gate to source voltage of 0 V due to a fluctuation in characteristics of N-type TFT 23. In this case, potentials at nodes N21 and N22 have even a chance to be gradually raised due to a considerably small current and to eventually cause potentials at nodes N21 and N22 to exceed threshold voltage VTN of N-type TFT 24. In Embodiment 2, it is aimed to solve this problem.

Figure 8:
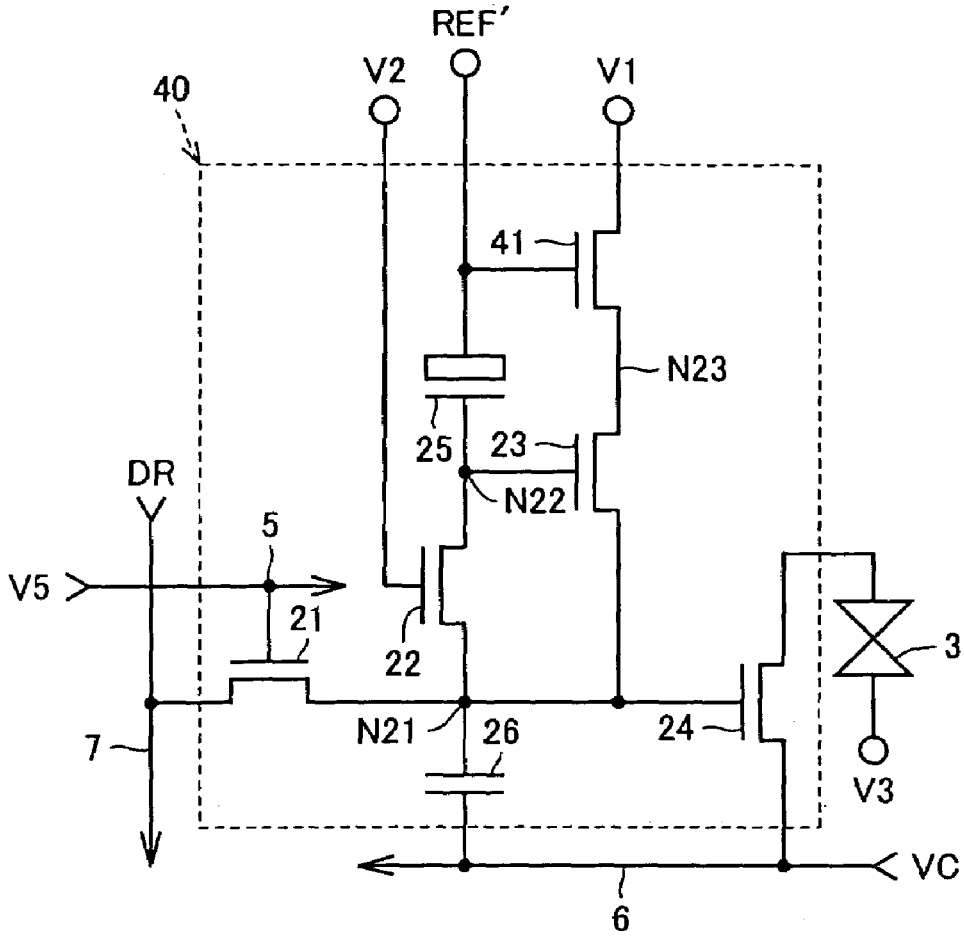
FIG. 8 is a circuit diagram showing a main part of a color liquid crystal display according to Embodiment 2 of the present invention.
Figure 9:
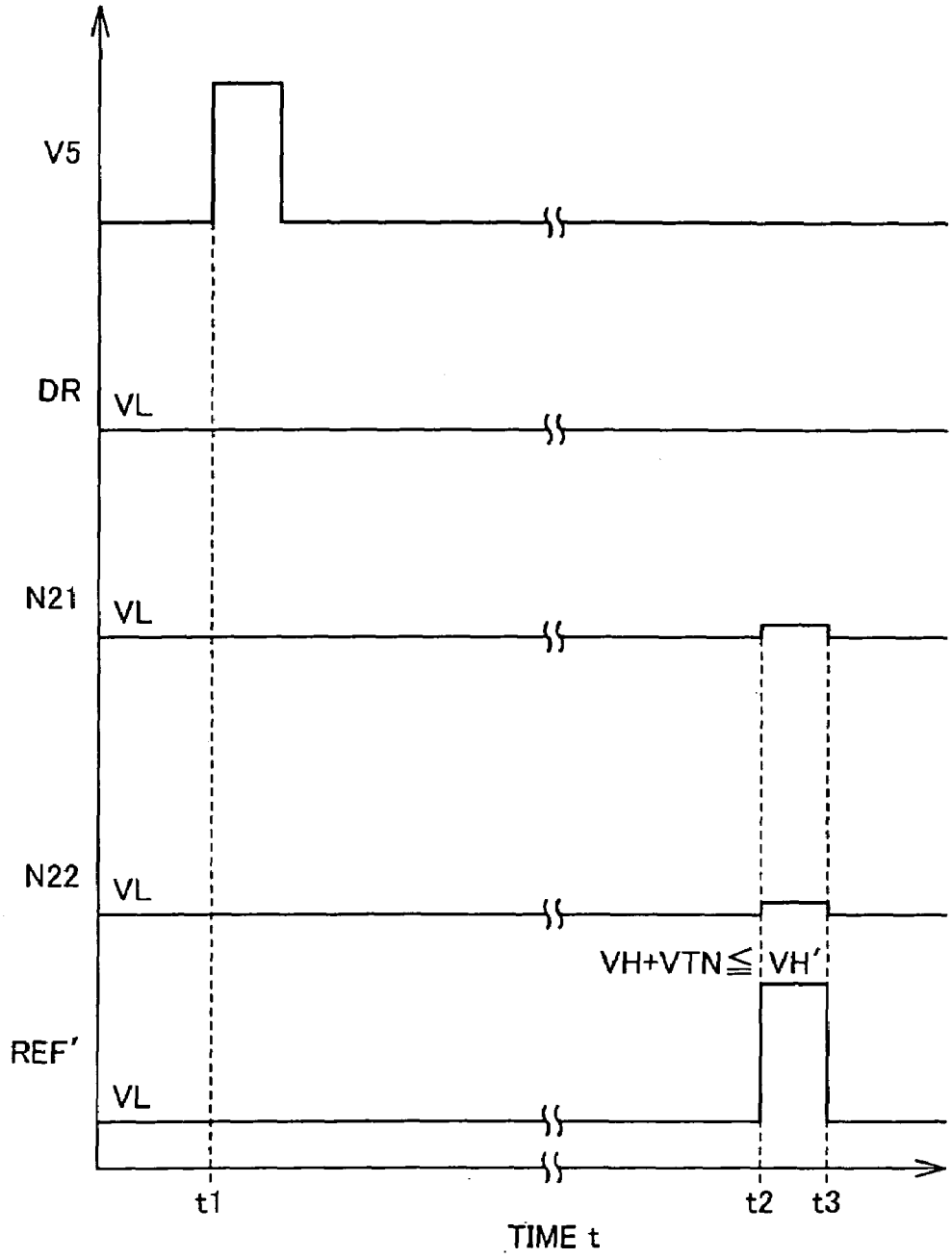
FIG. 9 is a timing chart for describing an operation of the liquid crystal drive circuit shown in FIG. 8.

FIG. 8 is a circuit diagram showing a configuration of a liquid crystal drive circuit 40 of a color liquid crystal display according to Embodiment 2 of the present invention, and the figure is to be compared with FIG. 2. Referring to FIG. 8, liquid crystal drive circuit 40 is different from liquid crystal drive circuit 20 of FIG. 2 in that N-type TFT 41 is added and that a refresh signal REF' is supplied instead of refresh signal REF. The drain of N-type TFT 41 receives drive potential V1, the source thereof is connected to the drain (a node N23) of N-type TFT 23, and the gate thereof receives refresh signal REF'. Refresh signal REF' is different from refresh signal REF in that "H" level of refresh signal REF', as shown in FIG. 9, is not VH, but a prescribed potential VH' equal to or higher than VH+VTN.

In FIG. 8, when refresh signal REF' is set to "L" level VL (0 V) in the case where nodes N21 and N22 are at "L" level, a considerably small off current flows in N-type TFTs 23 and 41 to gradually raise potentials at nodes N21 and N23. When a potential at node N23 is raised, however, a gate to source voltage of N-type TFT 41 takes a negative voltage; therefore, no off current flows in N-type TFT 41 to cease a rise in potentials at nodes N21 and N23.

When refresh signal REF' is set to "H" level VH', N-type TFT 41 is made conductive. At this time, since "H" level VH' of refresh signal REF' is set to VH+VTN or higher, no voltage drop occurs due to threshold voltage VTN of N-type TFT 41.

Note that needless to say that capacitor 25 of an N-type TFT structure is replaced with capacitor 37 of a P-type TFT structure shown in FIGS. 6 and 7.

When refresh signal REF' is raised from "L" level to "H" level in the case where data holding node N21 is at "L" level, potentials at nodes N21 and N22 are somewhat raised due to a considerably small capacitance value of capacitor 25. In order to cause a rise, at this time, in potentials at nodes N21 and N22 to be smaller, a necessity arises for minimize a capacitance value of capacitor 25 under conditions where an N-type channel layer is hard to be generated in intrinsic polysilicon film 31 of capacitor 25. Therefore, a configuration may be adopted in which "L" level of refresh signal REF' is set not to VL (0 V) but to a positive potential VL' (for example 1 V) to thereby maintain a gate to source voltage of capacitor 25 at a negative voltage.

Figure 10:
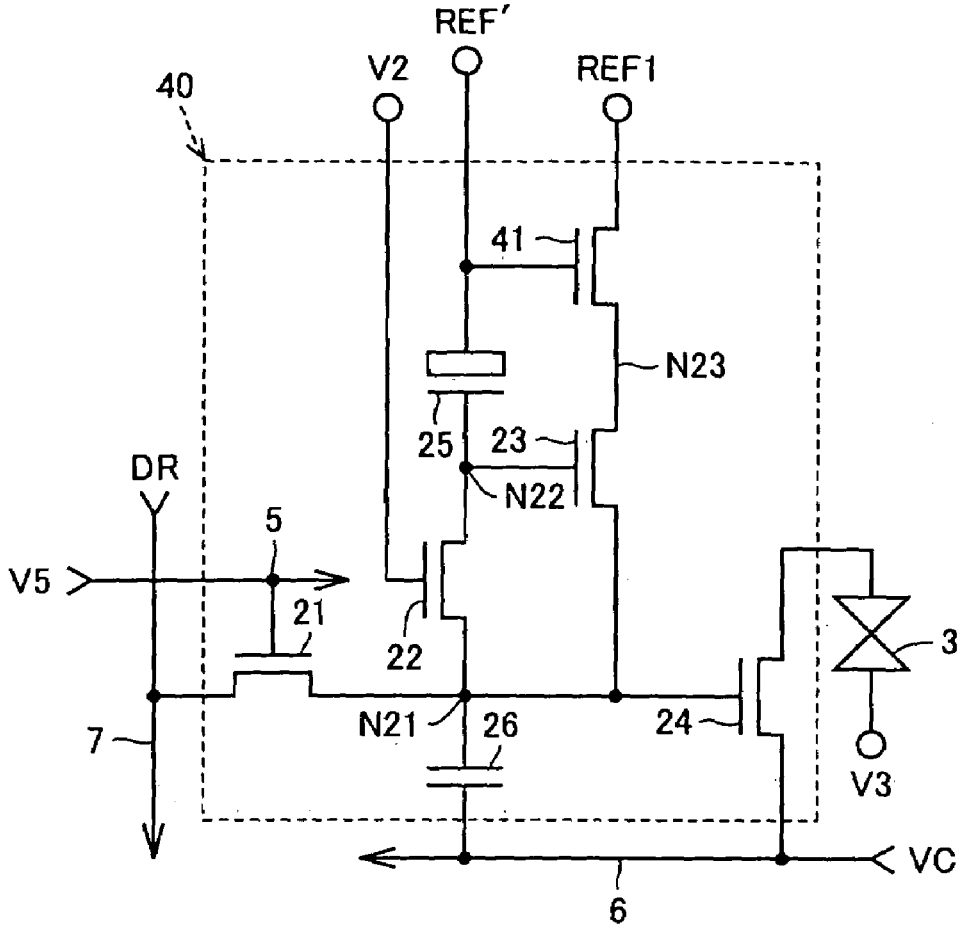
FIG. 10 is a circuit diagram showing a modification example of Embodiment 2.
Figure 11:
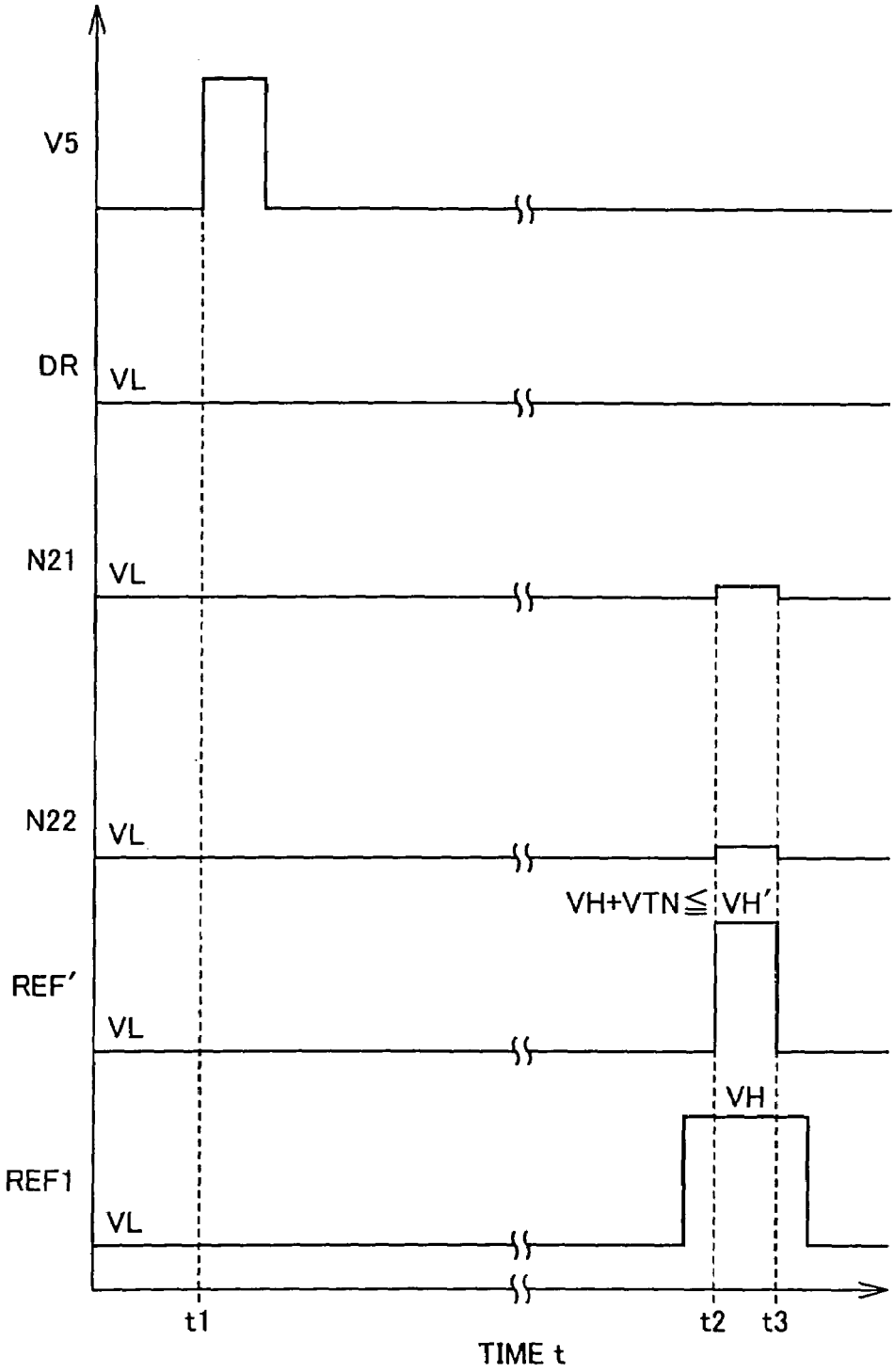
FIG. 11 is a timing chart for describing an operation of a liquid crystal drive circuit shown in FIG. 10.

In a modification example of FIG. 10, refresh signal REF1 is supplied to the drain of N-type TFT 41 of liquid crystal drive circuit 40 instead of drive potential V1. As shown in FIG. 11, refresh signal REF1 is kept at "H" level VH only during a period (from time t2 to time t3) when refresh signal REF' is at "H" level VH and prescribed periods before and after the period (from time t2 to time t3) while being kept at "L" level VL during the other periods. Therefore, a leakage current flowing in N-type TFTs 23 and 41 can be smaller. Note that in this modification example as well, needless to say that capacitor 25 of an N-type TFT structure may be replaced with capacitor 37 of a P-type TFT structure shown in FIGS. 6 and 7.

Figure 12:
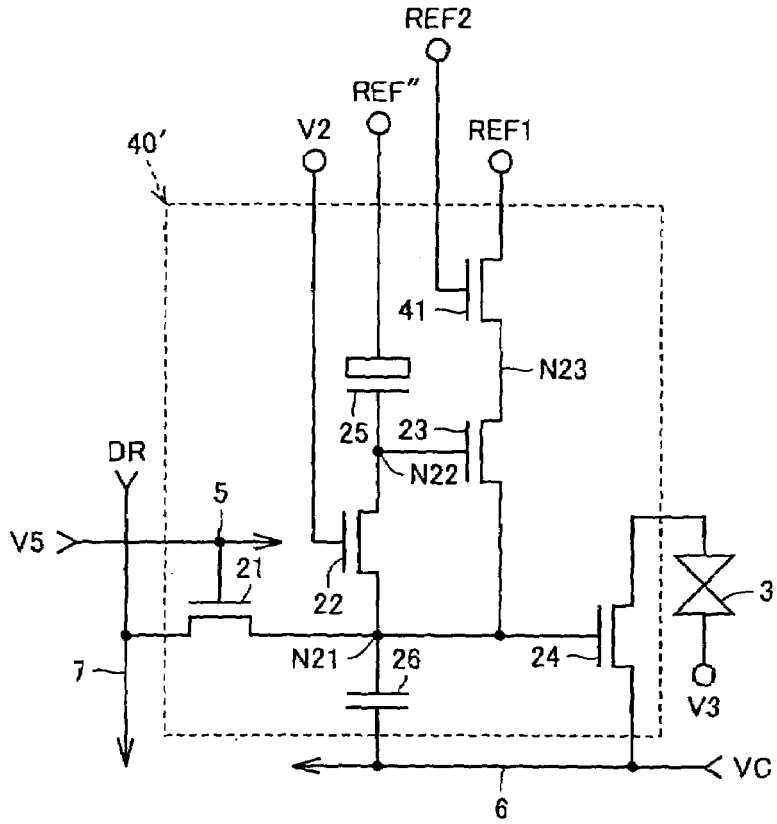
FIG. 12 is a circuit diagram showing another modification example of Embodiment 2.
Figure 13:
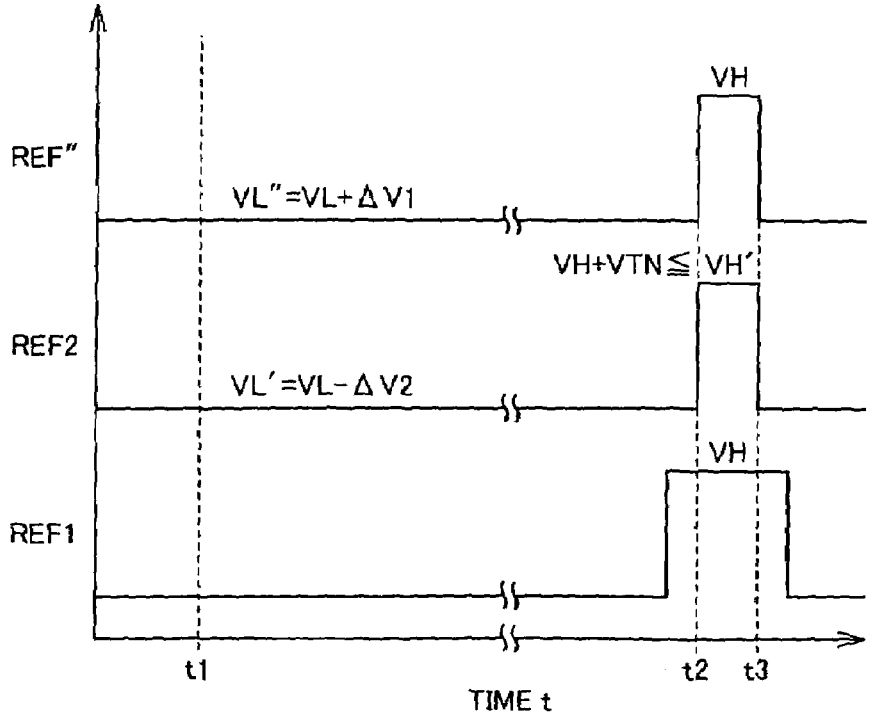
FIG. 13 is a timing chart for describing an operation of a liquid crystal drive circuit shown in FIG. 12.

In a modification example of FIG. 12, the gate of N-type TFT 41 and the source of capacitor 25 of liquid crystal drive circuit 40 are disconnected, refresh signal REF" is supplied to the source of capacitor 25, refresh signal REF2 is supplied to the gate of N-type TFT 41, and refresh signal REF1 is supplied to the drain of N-type TFT 41. As shown in FIG. 13, "L" level of signal REF" is not VL=0 V, but a positive potential VL"=VL+ΔV1 and "H" level of signal REF" is VH. For example, ΔV1 is 1 V. Under such a condition, a capacitance value of capacitor 25 in the case where nodes N21 and N22 are at "L" level can be smaller. Furthermore, "L" level of signal REF2 is not VL=0 V, but a negative potential VL'=VL−ΔV2 and "H" level of signal REF2 is VH'. For example, ΔV2 is 1 V. Under such a condition, a leakage current in N-type TFT 41 in the case where signal REF2 is at "L" level VL' can be smaller.

Embodiment 3

Figure 14:
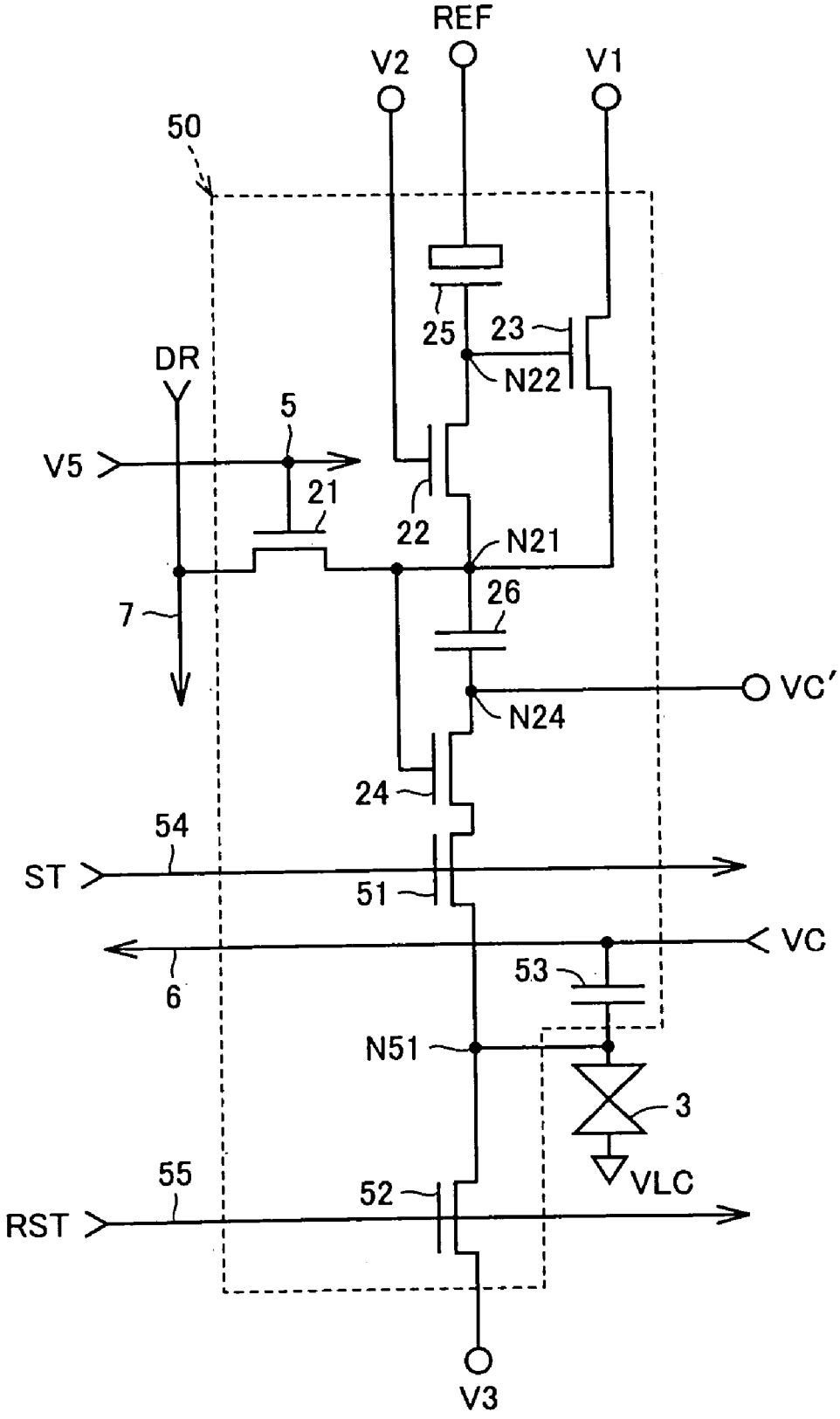
FIG. 14 is a circuit diagram showing a main part of a color liquid crystal display according to Embodiment 3 of the present invention.

FIG. 14 is a circuit diagram showing a main part of a color liquid crystal display according to Embodiment 3 of the present invention, and the figure is to be compared with FIG. 2.

In FIG. 14, the color liquid crystal display is different from color liquid crystal display 1 of Embodiment 1 in that liquid crystal drive circuit 20 is replaced with a liquid crystal drive circuit 50, that a set line 54 and a reset line 55 are added, and that a drive potential VC' and a reference potential VLC are newly introduced. Set line 54 and reset line 55 are driven, for example, by a vertical scan circuit.

Liquid crystal drive circuit 50 is constituted of liquid crystal drive circuit added with N-type TFTs 51 and 52 and a capacitor 53. Capacitor 26 is connected between node N21 and node N24. Node N24 receives drive potential VC'=VL supplied externally. A potential at data holding node N21 is maintained by capacitor 26.

N-type TFTs 24 and 51 are in series connected between node N24 and a node 51. The gate of N-type TFT 24 is connected to data holding node N21. The gate of N-type TFT 51 receives a set signal ST through set line 54.

When set signal ST is at "L" level at non-select level, N-type TFT 51 is made non-conductive. When set signal ST is set to "H" level at select level, N-type TFT 51 is made conductive. When data holding node N21 is at "L" level, N-type TFT 24 is made non-conductive and node 51 does not vary as is at drive potential V3. When data holding node N21 is at "H" level, N-type TFT 24 is made conductive to set node N51 to drive potential VC'.

The drain of N-type TFT 52 receives drive potential V3=VH, the source thereof is connected to node N51, the gate thereof receives reset signal RST through reset line 55. Capacitor 53 is connected between node N51 and common potential line 6.

When reset signal RST is at "L" level at non-select level, N-type TFT 52 is made non-conductive and a potential at node N51 is maintained as it is. When reset signal RST is set to "H" level at select level, N-type TFT 52 is made conductive and node N51 is reset to drive potential V3.

One electrode of liquid crystal cell 3 is connected to node N51 and the other electrode thereof receives reference potentials VLC=VL. When node N51 is reset to drive potential V3, a light transmittance of liquid crystal cell 3 takes, for example, the maximum value, while when node N51 is set to drive voltage VC', a light transmittance of liquid crystal cell 3 takes, for example, the minimum value.

Then, description will be given of an operation of the color liquid crystal display. In a data write period, scan line 5 is set to "H" level at select level to cause N-type TFT 21 to be made conductive and to write a potential on data signal line 7 to data holding node N21. When scan line 5 is set to "L" level at non-select level, N-type TFT 21 is made non-conductive to thereby, cause a potential at data holding node N21 to be maintained by capacitor 26.

In a data holding period, reset signal RST and set signal ST are sequentially set to "H" level for a prescribed time T2 at intervals of a prescribed time T1 (T2<T1). In such an operation, when data holding node N21 is at "H" level, node 51 is set to drive potential VC' while when data holding node N21 is at "L" level, node N51 is reset to drive potential V3.

Since a potential at data holding node N21 is gradually varied by a leakage current, a necessity arises for performing refresh of data at intervals of prescribed time T3 (T3>T1) in a data holding period. The refresh of a data signal is performed with N-type TFTs 22 and 23, and capacitor 25. Since a refresh method for a data signal is the same as in Embodiment 1, no description thereof will be repeated.

In Embodiment 3 as well, there can be obtained the same effect as in Embodiment 1.

Embodiment 4

Figure 15:
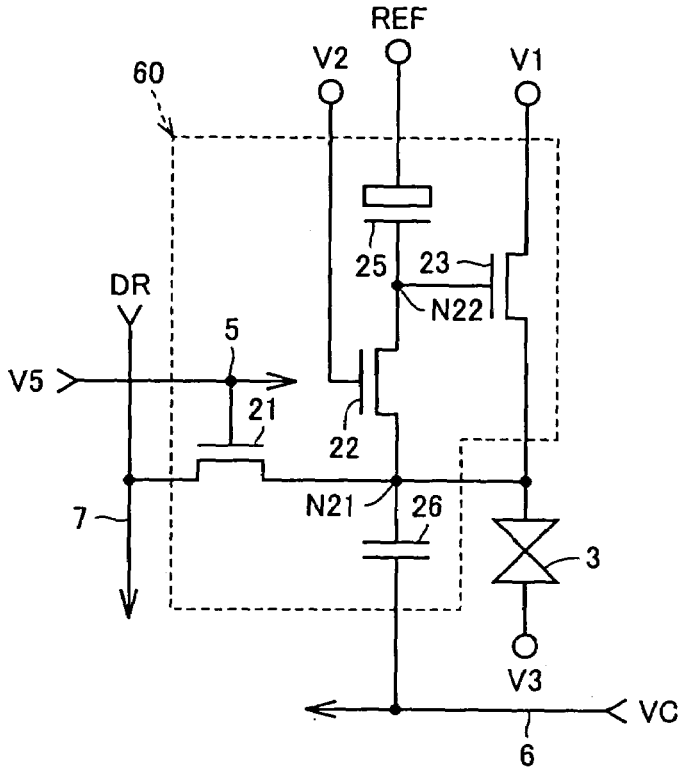
FIG. 15 is a circuit diagram showing a main part of a color liquid crystal display according to Embodiment 4 of the present invention.

FIG. 15 is a circuit diagram showing a liquid crystal drive circuit 60 of a color liquid crystal display according to Embodiment 4 of the present invention, and the figure is to be compared with FIG. 2.

Referring to FIG. 15, liquid crystal drive circuit 60 is different from liquid crystal drive circuit 20 of FIG. 2 in that N-type TFT 24 is deleted. One electrode of liquid crystal cell 3 is connected directly to data holding node N21.

When data holding node N21 is at "H" level VH, a voltage between electrodes of liquid crystal cell 3 is at 0 V and a light transmittance of liquid crystal cell 3 takes, for example, the minimum value. When data holding node N21 is at "L" level, a voltage between electrodes of liquid crystal cell 3 is at VH and a light transmittance of liquid crystal cell 3 takes, for example, the maximum value. The potential of data holding node N21 is refreshed using N-type TFTs 22 and 23 and capacitor 25.

In Embodiment 4 as well, there can be obtained the same effect as in Embodiment 1.

Embodiment 5

Figure 16:
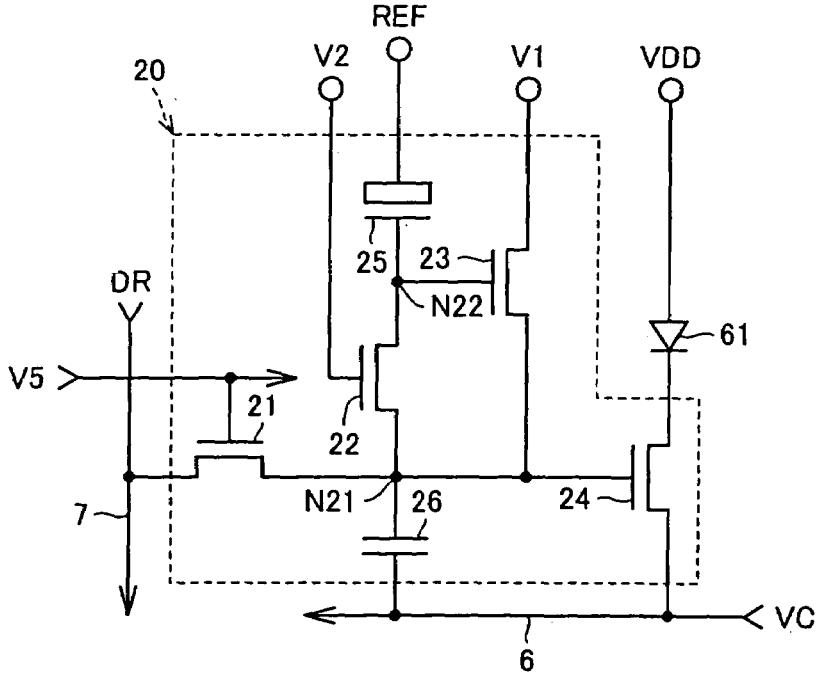
FIG. 16 is a circuit diagram showing a main part of an image display according to Embodiment 5 of the present invention.
Figure 17:
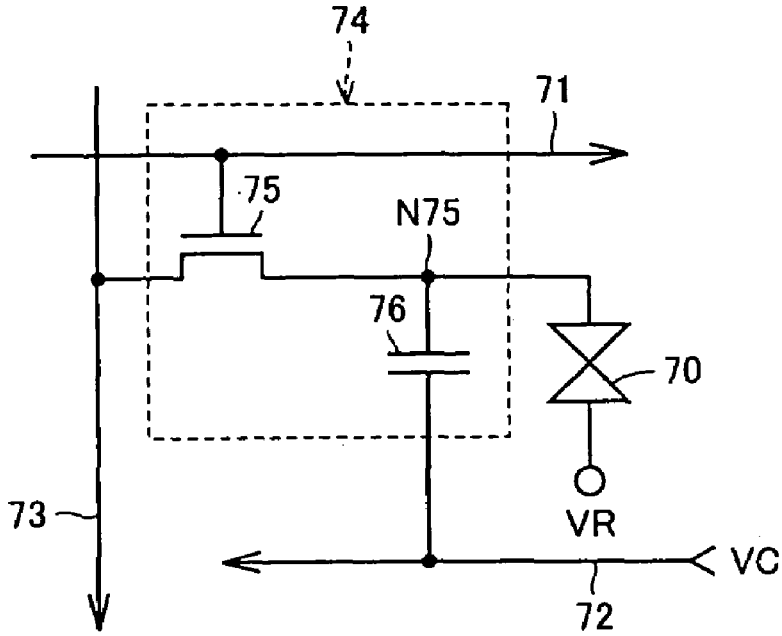
FIG.17 PRIOR ART
FIG. 17 is a circuit diagram showing a main part of a conventional liquid crystal display.
Figure 18:
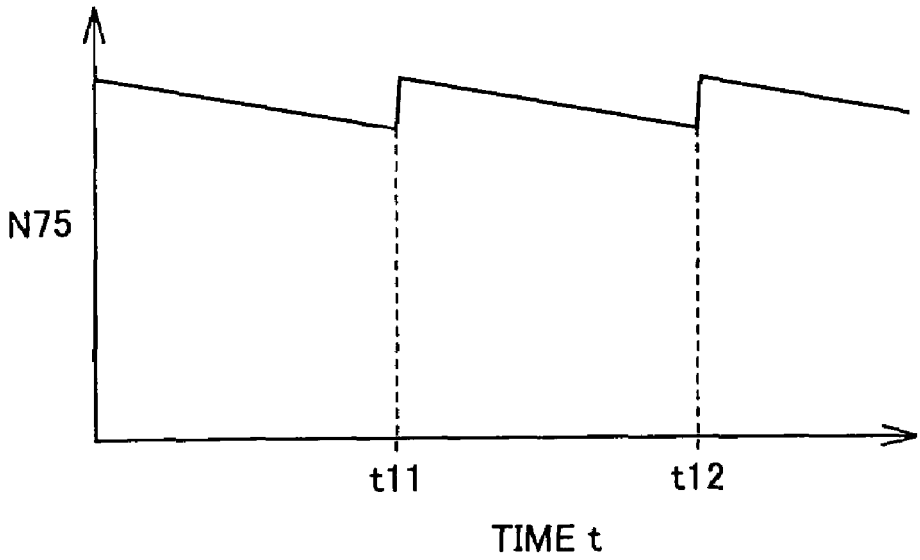
FIG.18 PRIOR ART
FIG. 18 is a timing chart for describing a problem in the conventional liquid crystal display.

FIG. 16 is a circuit diagram showing a main part of an image display according to Embodiment 5 of the present invention, and the figure is to be compared with FIG. 2.

Referring to FIG. 16, the image display is different from color liquid crystal display 1 of Embodiment 1 in that liquid crystal 3 is replaced with an organic EL (electroluminescence) element 61. Organic EL element 61 is connected between a node at power supply potential VDD and the drain of N-type TFT 24 of drive circuit 20.

When data holding node N21 is at "H" level, N-type TFT 24 is made conductive to cause a current to flow in organic EL element 61 and to cause organic EL element 61 to emit light. When data holding node N21 is at "L" level, N-type TFT 24 is made non-conductive to cause no current to flow in organic EL element 61 and to cause organic EL element 61 to emit no light. A potential at data holding node N21 is refreshed using N-type TFTs 22 and 23, and capacitor 25.

In Embodiment 5 as well, there can be obtained the same effect as in Embodiment 1.

Note that the same effect can be obtained in the case where organic EL element 61 is interposed between the source of N-type TFT 24 and common potential line 6, and power supply potential VDD is supplied to the drain of N-type TFT 24.

Furthermore, a display element of another kind may be used instead of organic EL element 61.

Needless to say that the embodiments and modification examples described above may be properly combined.

The embodiments disclosed this time should be considered to be presented by way of illustration and are not to be taken by way of limitation in all aspects. It is intended that the sprit and scope of the present invention are shown not by the above description but by the appended claims and include all modification or alterations within the scope of the appended claims and the scope equivalent thereto.

The invention claimed is:

1. An image display comprising:

a pixel display circuit displaying a pixel density corresponding to a potential of a data holding node;

a data write circuit applying one of first and second potentials to said data holding node in accordance with an image signal; and a refresh circuit refreshing a potential at said data holding node in response to a refresh signal when the potential at said data holding node exceeds a third potential, between the first and second potentials, and not refreshing the potential at said data holding node in response to a refresh signal when the potential at said data holding node does not exceed the third potential, wherein said refresh circuit includes:

a first capacitor having first and second electrodes, the second electrode receiving the refresh signal, said capacitor having a capacitance varying according to potential difference between the first and second electrodes;

a first field effect transistor, connected between the first electrode of said first capacitor and said data holding node, and having a gate electrode receiving a first drive potential; and a second field effect transistor having a first electrode receiving a second drive potential, having a second electrode connected to said data holding node, and having a gate electrode connected to the first electrode of said first capacitor.

2. The image display according to claim 1, wherein said first capacitor includes an N-channel field effect transistor, having a gate electrode as the first electrode, and having at least one of source and drain electrodes serving as the second electrode.

3. The image display according to claim 1, wherein said first capacitor includes a P-channel field effect transistor having a gate electrode as the second electrode, and having at least one of source and drain electrodes as the first electrode.

4. The image display according to claim 1, wherein the first drive potential is equal to a sum of the first potential and threshold voltage of said first field effect transistor, the second drive potential is equal to the first potential, and activation level of the refresh signal is equal to the first potential and deactivation level of the refresh signal is equal to the second potential.

5. The image display according to claim 1, wherein said refresh circuit further includes a third field effect transistor interposed between a node at the second drive potential and the first electrode of said second field effect transistor, and having a gate electrode receiving the refresh signal.

6. The image display according to claim 5, wherein the first drive potential is equal to a sum of the first potential and threshold voltage of said first field effect transistor the second drive potential is equal to the first potential, and activation level of the refresh signal is equal to a sum of the first potential and threshold voltage of said third field effect transistor and deactivation level of the refresh signal is equal to the second potential.

7. The image display according to claim 6, wherein the second drive potential is applied only during a period including a period in which the refresh signal is set at the activation level.

8. The image display according to claim 1, wherein said refresh circuit further includes a third field effect transistor interposed between a node at the second drive potential and the first electrode of said second field effect transistor, having a gate electrode receiving a control signal in synchronism with the refresh signal.

9. The image display according to claim 8, wherein the first drive potential is equal to a sum of the first potential and threshold voltage of said first field effect transistor, the second drive potential is equal to the first potential, activation level of the refresh signal is equal to the first potential and deactivation level of the refresh signal is equal to a potential obtained by level shifting the second potential to the first potential by a first voltage, and activation level of the control signal is equal to a sum of the first potential and threshold voltage of said third field effect transistor, and deactivation level of the control signal is equal to a potential obtained by level shifting the second potential away from the first potential by a second voltage.

10. The image display according to claim 9, wherein the second drive potential is applied only during a period including a period in which the refresh signal and the control signal are at the activation levels.

11. The image display according to claim 1, further comprising a second capacitor connected between said data holding node and a node at a reference potential.

12. The image display according to claim 1, wherein said pixel display circuit includes a liquid crystal cell having a first electrode connected to said data holding node, a second electrode receiving a drive potential, and a light transmittance which varies according to potential at said data holding node.

13. The image display according to claim 1, wherein said pixel display circuit includes:

a third field effect transistor having a gate electrode connected to said data holding node, and having a first electrode receiving a reference potential; and a liquid crystal cell having a first electrode connected to a second electrode of said third field effect transistor, a second electrode receiving a drive potential, and a light transmittance which varies according to conductive state of said third field effect transistor.

14. The image display according to claim 1, wherein said pixel display circuit includes:

a third field effect transistor having a gate electrode connected to said data holding node; and a light enuffing element, connected in series with said third field effect transistor between a node at a drive potential and a node at a reference potential, and an emitted light intensity of which varies according to a current flowing in said third field effect transistor.

15. The image display according to claim 1, comprising:

a plurality of pixel display circuits arranged in a plurality of rows and a plurality of columns, wherein said data write circuit includes:

a plurality of scan lines corresponding to said plurality of rows, respectively;

a plurality of data signal lines corresponding to said plurality of columns, respectively;

third field effect transistors corresponding to the respective pixel display circuits, each third field effect transfer being connected between the data holding node of a corresponding pixel display circuit and a corresponding data signal line, and each third field effect transistor being having a gate electrode connected to a corresponding scan line;

a vertical scan circuit sequentially selecting said plurality of scan lines to drive a selected scan line to a select level and to cause said third field effect transistor corresponding to said scan line selected to be made conductive; and a horizontal scan circuit sequentially selecting said plurality of data signal lines while one scan line is selected by said vertical scan circuit to apply one of the first and second potentials to a data line selected according to the image signal.

16. An image display comprising:

a pixel display circuit displaying a pixel density corresponding to a potential of a data holding node, wherein said pixel display circuit includes:

a field effect transistor having a gate electrode connected to said data holding node, and having a first electrode receiving a first drive voltage;

a switch circuit applying a second drive potential to a node in response to a reset signal, and connecting a second electrode of said field effect transistor to said node in response to a set signal; and a liquid crystal cell having a first electrode connected to said node, a second electrode receiving a reference potential, and a light transmittance which varies according to potential at said node;

a data write circuit applying one of first and second potentials to said data holding node in accordance with an image signal; and a refresh circuit rewriting the potential at said data holding node in response to an applied refresh signal when the potential at said data holding node exceeds a third potential, between the first and second potentials, and not rewriting the potential at said data holding node in response to an applied refresh signal when the potential at said data holding node does not exceed the third potential.

* * * * *